US007556509B1

(12) United States Patent
Oh et al.

(10) Patent No.: US 7,556,509 B1
(45) Date of Patent: Jul. 7, 2009

(54) BUS BAR CONNECTOR FOR CONNECTING BUS BAR TERMINAL TO PRINTED CIRCUIT BOARD

(75) Inventors: Min Woo Oh, Incheon (KR); Sung Kwan Choo, Hwaseong (KR)

(73) Assignees: Hyundai Motor Company, Seoul (KR); Kia Motors Corporation, Seoul (KR); Kyungshin Industrial Company, Incheon (KR)

( * ) Notice: Subject to any disclaimer, the term of this patent is extended or adjusted under 35 U.S.C. 154(b) by 0 days.

(21) Appl. No.: 12/229,174

(22) Filed: Aug. 19, 2008

(30) Foreign Application Priority Data

Apr. 22, 2008 (KR) ..... 10-2008-0037456

(51) Int. Cl.
*H01R 12/00* (2006.01)

(52) U.S. Cl. ..... 439/76.2; 439/850; 439/853

(58) Field of Classification Search ..... 439/76.2, 439/850, 853, 843–845, 849, 852, 861
See application file for complete search history.

(56) References Cited

U.S. PATENT DOCUMENTS 3,634,818 A * 1/1972 Horecky ..... 439/851
4,556,274 A * 12/1985 Olivera ..... 439/620.34
4,992,062 A * 2/1991 Nakayama et al. ..... 439/620.26
5,197,906 A * 3/1993 Watanabe et al. ..... 439/787
5,281,171 A * 1/1994 Job ..... 439/620.26
5,597,332 A * 1/1997 Walbrecht ..... 439/850
6,283,769 B1 * 9/2001 Asao et al. ..... 439/76.2
6,443,771 B2 * 9/2002 Kondo et al. ..... 439/620.27
6,905,348 B2 * 6/2005 Naitou et al. ..... 439/76.2
7,181,841 B2 * 2/2007 Masaoka ..... 29/861
7,387,516 B2 * 6/2008 Hayakawa et al. ..... 439/76.2
2001/0027060 A1 * 10/2001 Kondo et al. ..... 439/620
2005/0112958 A1 * 5/2005 Yagi et al. ..... 439/852

* cited by examiner

*Primary Examiner*—Gary F. Paumen
(74) *Attorney, Agent, or Firm*—Edwards Angell Palmer & Dodge LLP; Peter F. Corless

(57) ABSTRACT

A bus bar connector includes a terminal holder having a fastening space into and to which a bus bar terminal, mounted on a bus bar plate, is inserted and fastened, and a terminal lead coupled to a PCB. The terminal holder and the terminal lead are integrally connected to each other such that the bus bar terminal is electrically connected to the printed circuit board. The bus bar terminal is directly connected to the PCB without a fuse or a PCB terminal, leading to reduction in the number of parts, which advantageously simplifies an assembling process, reduces manufacturing costs, miniaturizes an entire unit, and simplifies the shape of the bus bar terminal.

13 Claims, 5 Drawing Sheets

BUS BAR CONNECTOR FOR CONNECTING BUS BAR TERMINAL TO PRINTED CIRCUIT BOARD

CLAIM OF PRIORITY

This application claims under 35 U.S.C. §119(a) the benefit of Korean Patent Application No. 10-2008-0037456 filed on Apr. 22, 2008, in the Korean Intellectual Property Office, the disclosure of which is incorporated herein by reference in its entirety.

BACKGROUND OF THE INVENTION

1. Field of the Invention

The present invention relates to a bus bar connector for connecting a bus bar terminal to a printed circuit board (PCB), and more particularly, to a bus bar connector for directly connecting a bus bar terminal to a PCB without a PCB terminal mounted on the PCB or a fuse connecting the PCB terminal with the bus bar terminal.

2. Description of the Related Art

A bus bar (or simply called a bus) is a conductor having low impedance and high current capacity, and can connect two or more respective circuits or join several like points in one system. A bus bar is generally used as a common conductor to distribute electric power to several points.

One type of bus bar is mounted on a bus bar plate and is electrically connected to a printed circuit board (PCB), which is placed below the bus bar plate.

A conventional connection structure of an exemplary bus bar and a PCB is described, with reference to FIGS. 1 and 2.

Exemplified in FIG. 1 is a perspective view illustrating the conventional connection structure of a bus bar and a PCB. Exemplified in FIG. 2 is a cross-sectional view illustrating the conventional connection structure of a bus bar and a PCB.

Referring to FIGS. 1 and 2, a bus bar plate 20 is placed parallel to the top face of the PCB 10, which is spaced apart from the bus bar plate at a predetermined interval. A bus bar 22, made of a metal plate, is provided on the top face of the bus bar plate 20.

The bus bar 22 has a bus bar terminal 24 extending upward therefrom, and the PCB 10 has a PCB terminal 12 extending upward therefrom through the bus bar plate 20. The bus bar terminal 24 and the PCB terminal 12 are electrically connected to each other by a separate fuse 30.

Hence, either electric current or electric signal suitably applied to the bus bar 22 is transmitted to the PCB 10 via the bus bar terminal 24, the fuse 30, and the PCB terminal 12 in that order (see arrows in FIG. 2).

The fuse 30 is merely a component, which electrically connects the bus bar terminal 23 with the PCB terminal 12 rather than protects a circuit by interrupting over current when the over current is applied to the bus bar 22 or the PCB 10. The PCB terminal 12 also is a component that simply transmits electric current or an electric signal from the bus bar terminal 24 to the PCB 10.

In certain cases, the bus bar terminal 23 and the PCB terminal 12 may be directly connected to each other without using the fuse 30. However, the fuse 30 is unavoidably used, since there is no suitable component that can electrically connect the bus bar terminal 23 with the PCB terminal 12.

The fuse 30 and the PCB terminal 12 are added to the conventional connection structure, which electrically connects the bus bar 22 to the PCB 10, thereby increasing the number of parts, making a manufacturing process more complicated, and increasing manufacturing costs. Furthermore, spaces for mounting the fuse 30 and the PCB terminal 12 are also required, thereby increasing the size of an entire unit.

Moreover, the top ends of the bus bar terminal 24 and the PCB terminal 12 are fork-shaped to hold the fuse 30, thereby making manufacturing processes thereof more complicated.

The above information disclosed in this the Background section is only for enhancement of understanding of the background of the invention and therefore it may contain information that does not form the prior art that is already known in this country to a person of ordinary skill in the art.

SUMMARY OF THE INVENTION

As described herein, the present invention is in certain aspects, directed to a bus bar connector, which is designed to directly connect a bus bar terminal to a printed circuit board (PCB) without a fuse or a PCB terminal, miniaturize an entire unit, and simplify a shape of the bus bar terminal.

In a preferred aspect of the invention, the bus bar connector includes a terminal holder, which has a fastening space, into and to which a bus bar terminal, mounted on a bus bar plate, is inserted and fastened; and a terminal lead, which is coupled to a PCB. In exemplary embodiments, the terminal holder and the terminal lead are integrally connected to each other such that the bus bar terminal is electrically connected to the printed circuit board.

The bus bar connector may further include a pair of vertical plates; and a pair of contacts extending at a downward incline from top ends of the vertical plates, respectively, so as to approach each other. The terminal holder is provided between the vertical plates, and the terminal lead extends downwardly from a bottom end of at least one of the vertical plates.

The bus bar connector may further include terminal guides, each of which connects a lateral edge of the first vertical plate to a corresponding lateral edge of the second vertical plate, so that the terminal guides and the vertical plates surround the fastening space.

In preferred embodiments, at least one of the terminal guides may have a contact inspection hole, which exposes all or part of the fastening space in a lateral direction.

The bus bar connector may preferably further include reinforcement ribs, each of which extends from a distal end of a corresponding one of the contacts to a corresponding one of the vertical plates.

As set forth above, in exemplary embodiments, the bus bar connector of the invention can directly connect the bus bar terminal to the PCB without a fuse or a PCB terminal, leading to reduction in the number of parts, which can advantageously simplify an assembling process, reduce manufacturing costs, miniaturize the entire unit, and simplify the shape of the bus bar terminal.

The above features and advantages of the present invention will be apparent from or are set forth in more detail in the accompanying drawings, which are incorporated in and form a part of this specification, and the following Detailed Description, which together serve to explain by way of example the principles of the present invention.

BRIEF DESCRIPTION OF THE DRAWINGS

The above and other objects, features and other advantages of the present invention will be more clearly understood from the following detailed description taken in conjunction with the accompanying drawings, in which.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

DETAILED DESCRIPTION OF THE EXEMPLARY EMBODIMENTS

As described herein the present invention includes a bus bar connector comprising a terminal holder, which has a fastening space, into and to which a bus bar terminal, mounted on a bus bar plate, is inserted and fastened and a terminal lead, which is coupled to a printed circuit board. In certain preferred embodiment, the terminal holder and the terminal lead are integrally connected to each other such that the bus bar terminal is electrically connected to the printed circuit board.

In other preferred embodiments, the bus bar connector further comprises a pair of vertical plates and a pair of contacts extending at a downward incline from top ends of the vertical plates, respectively, so as to approach each other. In related embodiments, the terminal holder is provided between the vertical plates, and the terminal lead extends downwardly from a bottom end of at least one of the vertical plates. In other preferred embodiments, the bus bar connected as described herein further comprises terminal guides, each of which connects a lateral edge of the first vertical plate to a corresponding lateral edge of the second vertical plate, and wherein the terminal guides and the vertical plates surround the fastening space. In related embodiments, at least one of the terminal guides has a contact inspection hole, wherein the contact inspection hole exposes all or part of the fastening space in a lateral direction. In other preferred embodiments, the bus bar connector further comprises reinforcement ribs. In a related embodiment, each of the reinforcement ribs extends from a distal end of a corresponding one of the contacts to a corresponding one of the vertical plates.

Hereinafter, a bus bar connector of the present invention will be described more fully with reference to the accompanying drawings, in which an exemplary embodiment thereof is shown.

Figure 3:
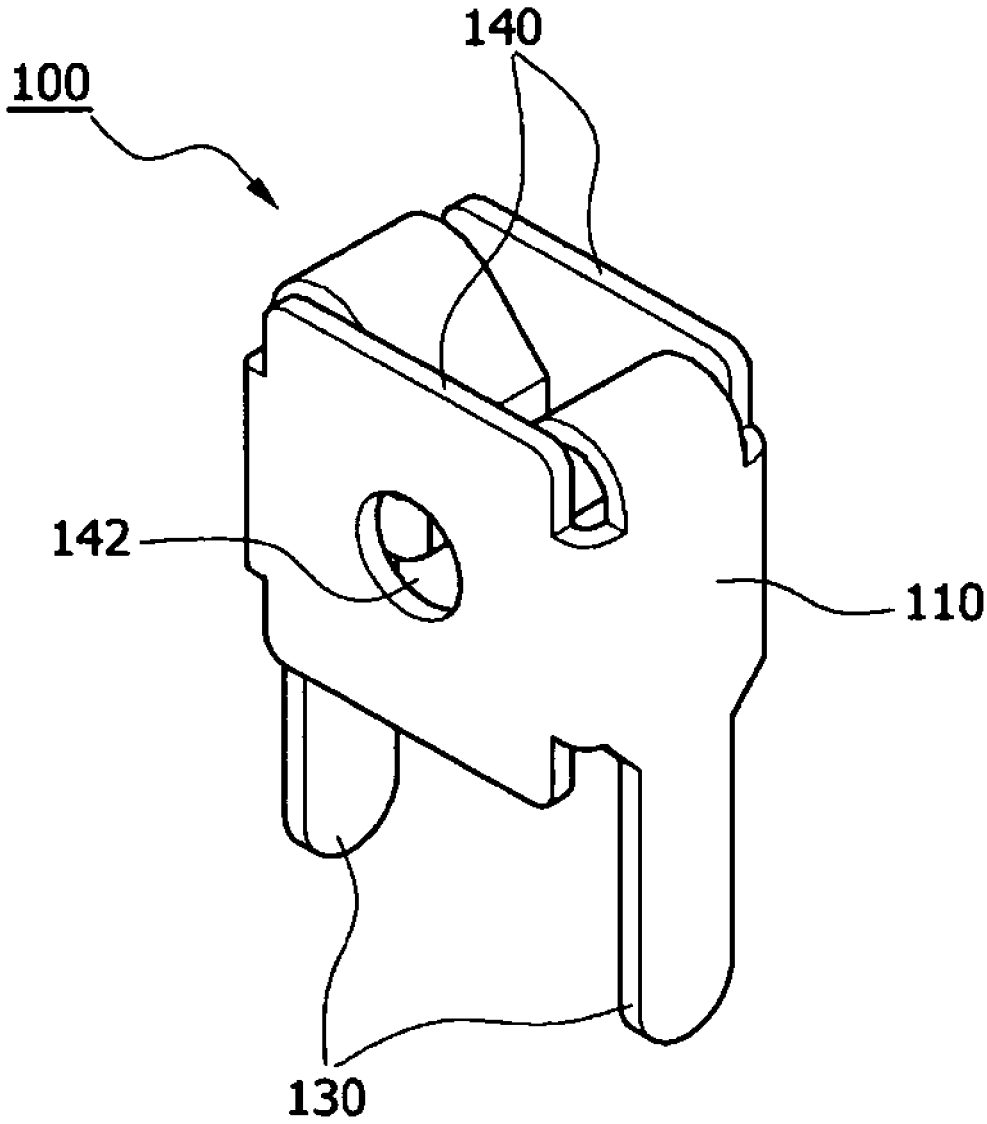
FIG. 3 is a perspective view of a bus bar connector according to the invention.
Figure 4:
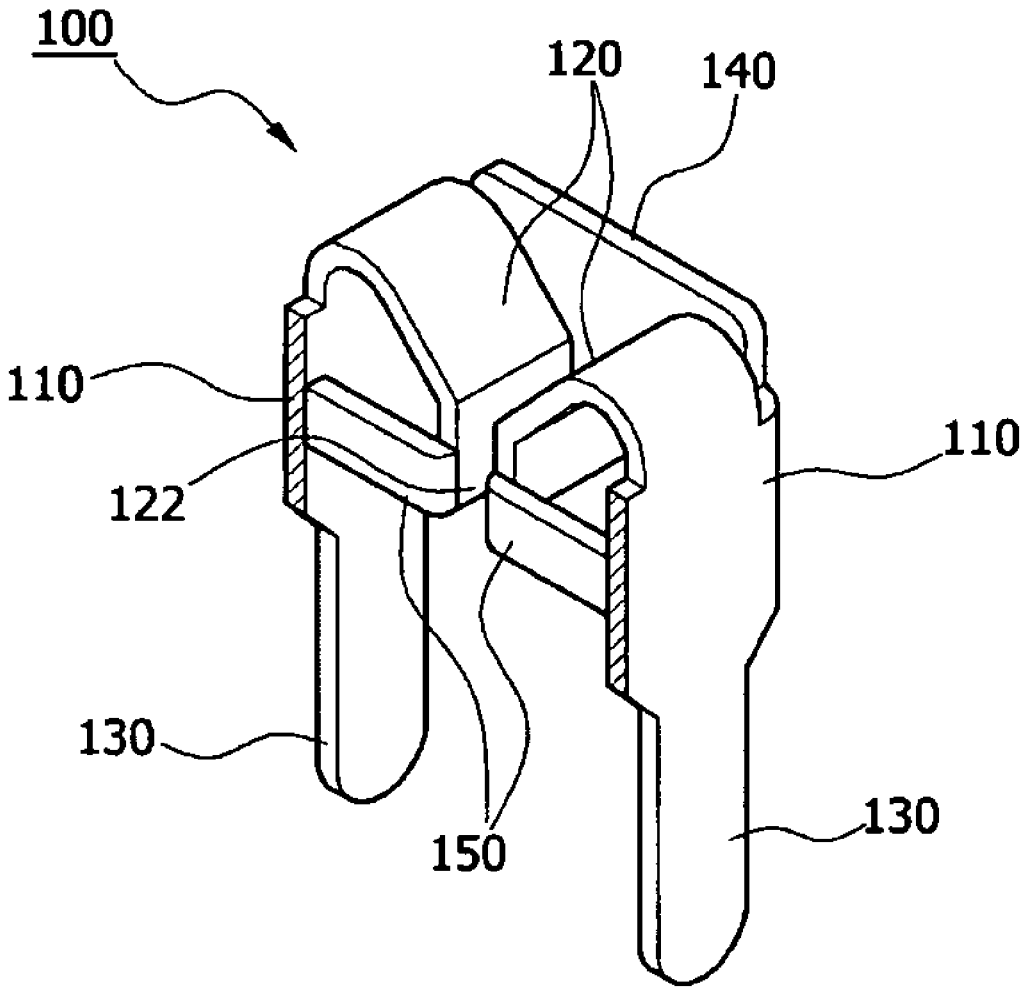
FIG. 4 is a perspective cross-sectional view illustrating the internal structure of the bus bar connector according to the invention.

FIG. 3 is a perspective view illustrating an exemplary bus bar connector according to the invention, and FIG. 4 is a perspective cross-sectional view illustrating an exemplary internal structure of a bus bar connector according to the invention.

The bus bar connector 100 according to preferred embodiments of the present invention functions to suitably electrically connect a bus bar terminal 24, which is mounted on a bus bar plate 20, to a printed circuit board (PCB) 10, and, in certain embodiments, includes a terminal holder having a fastening space 122 into and to which the bus bar terminal 24 is inserted and fastened. FIG. 10 illustrates exemplary bus bar terminal 24, bus bar plate 20 and PCB 10 according to certain embodiments. The bus bar connector 100 according to preferred embodiments of the present invention includes a pair of vertical plates 110 standing erect parallel to each other so as to be opposite each other, a pair of contacts 120 extending at a downward incline from top ends of the vertical plates 110, respectively, so as to approach each other, and a pair of terminal leads 130 extending downwardly from lower ends of the vertical plates 110.

In certain embodiments, the contacts 120 are suitably spaced apart from each other at predetermined intervals, thereby defining the fastening space 122 therebetween into and to which the bus bar terminal 24 is inserted and fastened. The interval between the contacts 120 can be suitably less than or equal to the thickness of the bus bar terminal 24, so that the contacts 120 can stably maintain the state in which the bus bar terminal 24 is inserted into and fastened to the fastening space 122.

While this preferred embodiment has been described as having the fastening space 12 formed by the separated contacts 120, the fastening space 112 is not limited to the illustrative structure of this embodiment. Thus, any structure will do as long as the bus bar terminal 24 can be suitably fitted into the fastening space 112.

As described herein, the bus bar connector 100 in preferred embodiments is coupled to the bus bar plate 20 by receiving the entire portion of the distal end of the bus bar terminal 24 in the fastening space 122. This makes it unnecessary to form the distal end of the bus bar terminal 24 in a specific shape such as a fork so as to be coupled with the fuse 30, as illustrated in exemplary FIG. 1. In certain preferred embodiments, the shape of the bus bar terminal 24 can be simplified according to the bus bar connector 100 of the invention.

In preferred embodiments, if the distal ends of the contacts 120 are deformed so as to move away from each other when the bus bar terminal 24 is inserted into the contacts 120, the bus bar terminal 24 cannot be kept in a stably fastened position. Accordingly, reinforcement ribs 150, which extend toward the vertical plates 110, can be additionally suitably provided to the respective distal ends of the contacts 120.

In other preferred embodiments, if the distal ends of the reinforcement ribs 150 are spaced apart from the vertical plates 110 at a predetermined interval, it is difficult to prevent the distal ends of the contacts 120 from being deformed. Therefore, the distal ends of the reinforcement ribs 150 can be suitably configured to be in contact with or be slightly spaced apart from the vertical plates 110.

Furthermore, in the position where the bus bar terminal 24 is inserted into the fastening space 122, when vibration or external force is applied to the vertical plates 110 in a widthwise direction thereof, there is a danger that the bus bar terminal 24 may escape from the fastening space 122.

In certain examples, the bus bar connector 100 of the invention may further include a pair of terminal guides 140. Each of the terminal guides 140 is connected, at one lateral edge thereof to one lateral edge of one of the vertical plates 110 and, at the opposite lateral edge thereof, with the corresponding lateral edge of the other one of the vertical plate 110, so that the terminal guides 140 and the vertical plates 110 are suitably connected to each other to surround the fastening space 122. This can prevent the bus bar terminal 24 from escaping from the fastening space 122 in the lateral direction once the bus bar terminal 24 is inserted into the fastening space 122. In preferred embodiments, the provides an advantageous effect.

Since the fastening space 122 is surrounded by the vertical plates 110 and the guides 140, it may be difficult for a worker to visually inspect whether or not the bus bar terminal 24 is correctly inserted into the fastening space 122 and is in normal contact with the contacts 120. Therefore, in preferred embodiments, a contact inspection hole 142 can be formed in at least one of the terminal guides 140 to laterally expose part or all of the fastening space 122, so that the worker can inspect the contacted state between the bus bar terminal 24 and the contacts 120 through the through-hole 142.

Figure 5:
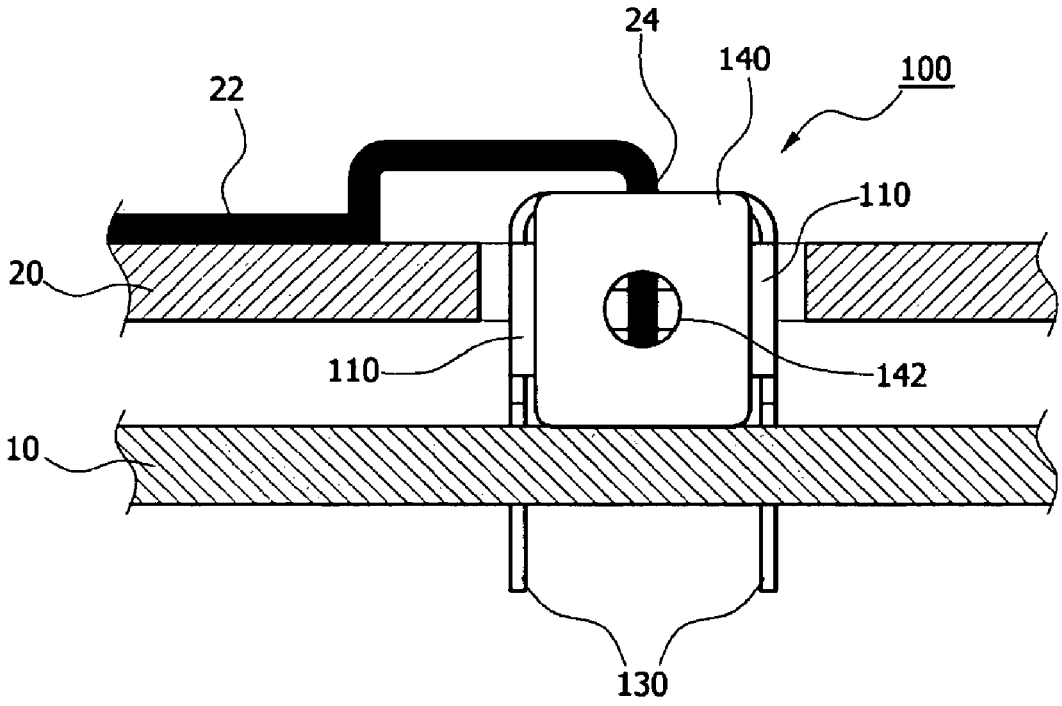
FIG. 5 is front elevation view illustrating one usage of the bus bar connector according to the invention.

FIG. 5 is an exemplary front elevation view illustrating one usage of the bus bar connector according to the invention.

The bus bar connector 100 of the invention is fixedly coupled to the PCB 10 by setting the terminal leads 130, extending downwardly from the vertical plates 110, so as to pass through the PCB 10. In certain preferred embodiments, the bus bar plate 20 and the PCB 10 are spaced apart from each other at a very narrow interval, so that part of the top end of the bus bar connector 100 of the invention extends upwardly beyond the top surface of the bus bar plate 20.

As described above, when the bus bar connector 100 is fixedly coupled to the PCB 10, the bus bar terminal 24 coupled to the bus bar plate 20 is bent down in the middle thereof, and is inserted, at the distal end thereof, into the fastening space 122, thereby remaining in contact with the contacts 120.

In preferred embodiments, a through-hole can be formed in a portion of the PCB 10, corresponding to the distal end of the bus bar terminal 24, so that the worker can suitably visually inspect whether or not the bus bar terminal 24 is sufficiently inserted into the fastening space 122.

Figure 1:
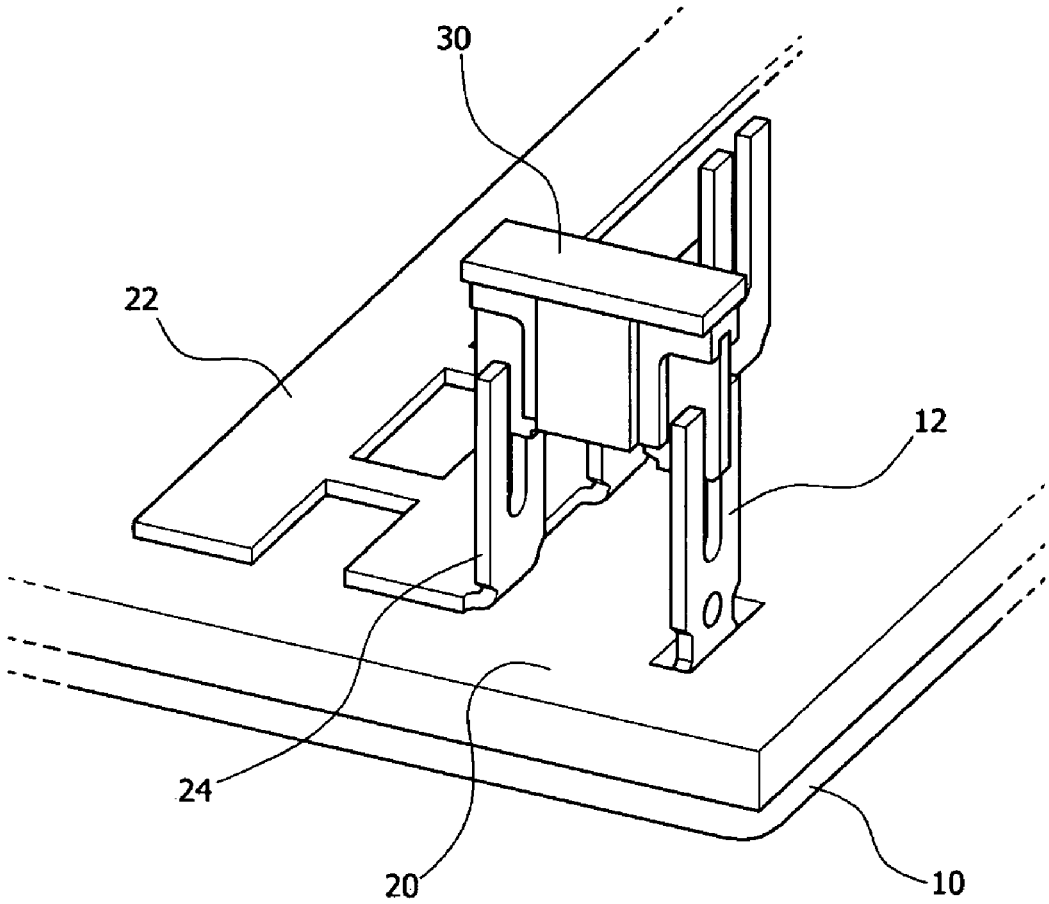
FIG. 1 is a perspective view of a connection structure of a bus bar and a PCB of the prior art.

In the case of the conventional connection structure of the bus bar 22 and the PCB 10 exemplified in FIG. 1, the current or the electric signal applied to the bus bar terminal 24 is transmitted to the PCB 10 through two components including the fuse 30 and the PCB terminal 24. However, according to the bus bar connector 100 of the instant invention, in certain embodiments, the current or the electric signal applied to the bus bar 22 is transmitted to the PCB 10 through only one component, that is suitably the bus bar connector 100. This, can reduce the loss of the current or the electric signal and is an advantageous effect of the invention described herein.

As described in preferred embodiments of the instant invention, the number of parts is reduced, manufacturing costs of the parts and thus manufacturing costs of the entire unit can also be reduced. Further, in preferred embodiments, manufacturing processes for the respective parts can also be simplified, thereby facilitating an assembling process.

Figure 2:
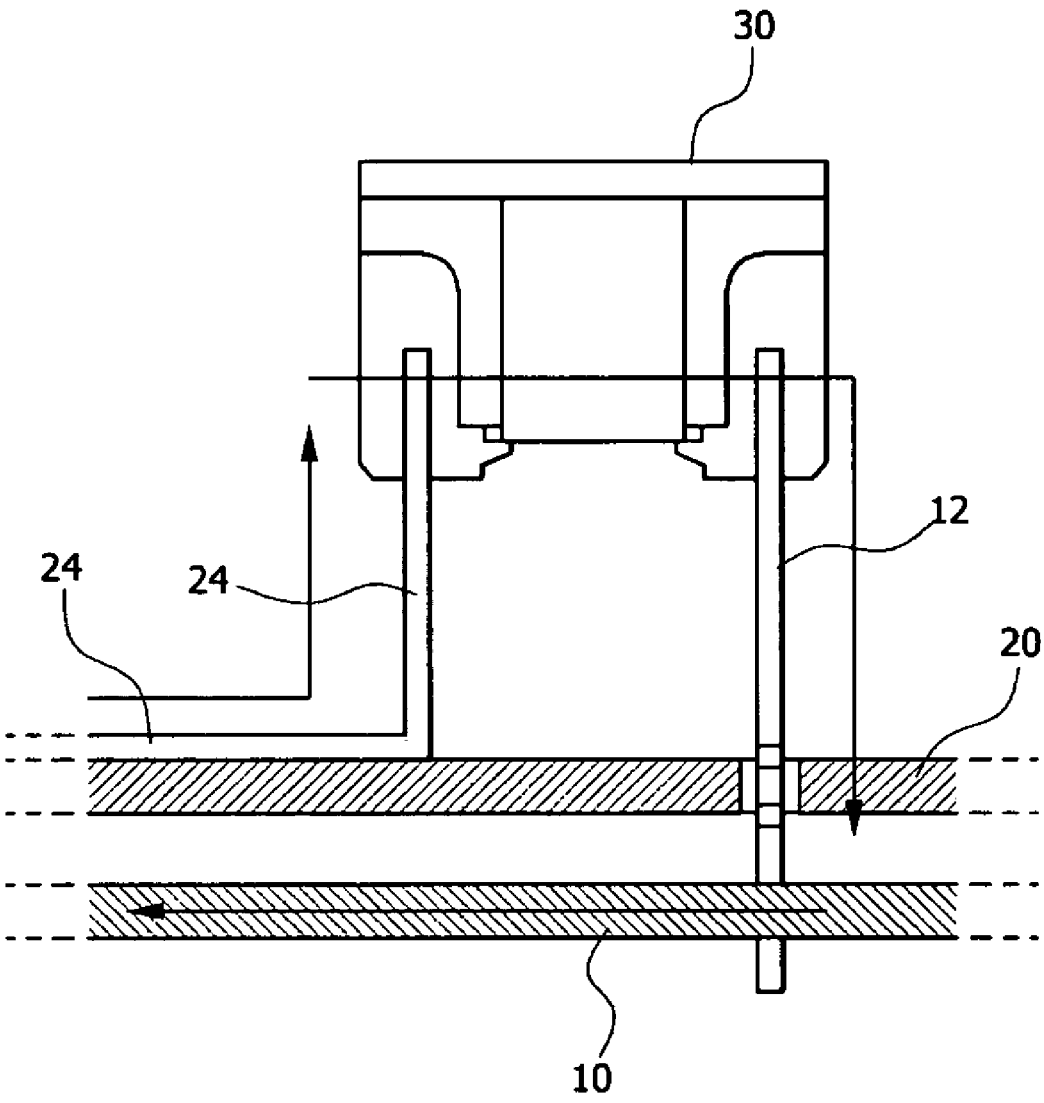
FIG. 2 is a cross-sectional view of the connection structure of the bus bar and the PCB of the prior art.

In the case of the conventional connection structure of the bus bar 22 and the PCB 10 exemplified in FIG. 2, there is required an assembly space corresponding to the height of the fuse 30 added to the height of the bus bar terminal 24 and the PCB terminal 12 protruding from the top surface of the bus bar plate 20. This requirement can be overcome by the bus bar connector 100 as described in preferred embodiments of the instant invention, which reduces the assembly space, and thus reduces the size of the entire unit.

While the present invention has been described with reference to the particular illustrative embodiments and the accompanying drawings, it is not to be limited thereto but will be defined by the appended claims. It is to be appreciated that those skilled in the art can substitute, change or modify the embodiments in various forms without departing from the scope and spirit of the present invention.

What is claimed is:

1. A bus bar connector comprising:

a terminal holder, which has a fastening space, into and to which a bus bar terminal, mounted on a bus bar plate, is inserted and fastened;

a terminal lead, which is coupled to a printed circuit board;

a pair of vertical plates; and a pair of contacts extending at a downward incline from top ends of the vertical plates, respectively, so as to approach each other, wherein the terminal holder and the terminal lead are integrally connected to each other such that the bus bar terminal is electrically connected to the printed circuit board, wherein the terminal holder is provided between the vertical plates, and wherein the terminal lead extends downwardly from a bottom end of at least one of the vertical plates.

2. The bus bar connector according to claim 1, further comprising terminal guides, each of which connects a lateral edge of the first vertical plate to a corresponding lateral edge of the second vertical plate, so that the terminal guides and the vertical plates surround the fastening space.

3. The bus bar connector according to claim 2, wherein at least one of the terminal guides has a contact inspection hole, which exposes all or part of the fastening space in a lateral direction.

4. The bus bar connector according to claim 3, further comprising:

reinforcement ribs, each of which extends from a distal end of a corresponding one of the contacts to a corresponding one of the vertical plates.

5. The bus bar connector according to claim 2, further comprising:

reinforcement ribs, each of which extends from a distal end of a corresponding one of the contacts to a corresponding one of the vertical plates.

6. The bus bar connector according to claim 1, further comprising:

reinforcement ribs, each of which extends from a distal end of a corresponding one of the contacts to a corresponding one of the vertical plates.

7. A bus bar connector comprising:

a terminal holder, which has a fastening space, into and to which a bus bar terminal, mounted on a bus bar plate, is inserted and fastened;

a terminal lead, which is coupled to a printed circuit board;

a pair of vertical plates; and a pair of contacts extending at a downward incline from top ends of the vertical plates, respectively, so as to approach each other.

8. The bus bar connector according to claim 7, wherein the terminal holder and the terminal lead are integrally connected to each other such that the bus bar terminal is electrically connected to the printed circuit board.

9. The bus bar connector according to claim 7, wherein the terminal holder is provided between the vertical plates, and wherein the terminal lead extends downwardly from a bottom end of at least one of the vertical plates.

10. The bus bar connector according to claim 7, further comprising terminal guides, each of which connects a lateral edge of the first vertical plate to a corresponding lateral edge of the second vertical plate, and wherein the terminal guides and the vertical plates surround the fastening space.

11. The bus bar connector according to claim 10, wherein at least one of the terminal guides has a contact inspection hole, wherein the contact inspection hole exposes all or part of the fastening space in a lateral direction.

12. The bus bar connector according to claim 7, further comprising reinforcement ribs.

13. The bus bar connector according to claim 12, wherein the bus bar connector further comprises:

a pair of vertical plates;

a pair of contacts extending at a downward incline from top ends of the vertical plates, respectively, so as to approach each other; and wherein each of the reinforcement ribs extends from a distal end of a corresponding one of the contacts to a corresponding one of the vertical plates.

* * * * *